United States Patent [19]

Müller

[11] Patent Number: 4,474,096

[45] Date of Patent: Oct. 2, 1984

[54] KNIFE HOLDER FOR A LONGITUDINAL SLITTER

[75] Inventor: Horst Müller, Pfungstadt, Fed. Rep. of Germany

[73] Assignee: Dr. Otto C. Strecker Kommanditgesellschaft, Pfungstadt, Fed. Rep. of Germany

[21] Appl. No.: 440,605

[22] Filed: Nov. 10, 1982

[30] Foreign Application Priority Data

Nov. 20, 1981 [DE] Fed. Rep. of Germany ..... 3146116

[51] Int. Cl.[3] ..... B26D 5/04

[52] U.S. Cl. ..... 83/482; 83/502; 83/503

[58] Field of Search ..... 83/482, 501–504, 83/507, 469

[56] References Cited

U.S. PATENT DOCUMENTS 3,892,156 7/1975 Johnstone ..... 83/482 X
4,257,299 3/1981 Aykut ..... 83/482
4,380,945 4/1983 Guild ..... 83/482

FOREIGN PATENT DOCUMENTS 1024341 2/1958 Fed. Rep. of Germany .
1156635 10/1963 Fed. Rep. of Germany .
2244421 1/1978 Fed. Rep. of Germany .

*Primary Examiner*—James M. Meister
*Attorney, Agent, or Firm*—Oblon, Fisher, Spivak, McClelland & Maier

[57] ABSTRACT

A rotary knife holder for a longitudinal slitter in which a rotary knife disc 8 is displaceable relative to a second rotary knife disc 10, co-operating therewith, by separate pneumatic cylinders 12 and 14 to which air is supplied by a common controllable feed line 26 against a resilient restoring force initially radially and then axially. To achieve instant response, to permit the feed speed and feed force for the cylinder 14 to be as independently adjustable as possible and, in addition, to avoid any slip-stick effect in the axial feed movement, an adjustable reducing valve 38 is connected prior to the cylinder 14. This reducing valve 38 is double-acting and is filled with a damping fluid which, during the feed stroke, is expelled through a throttle member 50 into an air vessel 52. Pneumatic pressure medium from the air vessel 52, which in the example also supplies the resilient restoring force, is feedable by way of an adjustable reducing valve which may be the same reducing valve by which the cylinder 14 (the axial feed movement) is fed.

7 Claims, 2 Drawing Figures

KNIFE HOLDER FOR A LONGITUDINAL SLITTER

BACKGROUND OF THE INVENTION

1. Field of the Invention:

The invention relates to a knife holder or cutting blade for a longitudinal slitter or cutter, a rotary knife disc of which is displaceable relative to a second rotary knife disc cooperating therewith, by separate pneumatic linear drive members which are however adapted to be fed from a common controllable feed line, from an initial position, in which the knife discs are out of engagement, against a resilient restoring force, initially radially and then axially, there being a flow-limiting member connected upstream of the linear drive member for the axial feed movement. With such longitudinal slitters, material webs, for example of paper, are divided longitudinally into individual strips.

2. Description of the Prior Art:

In the known constructions of longitudinal slitters of the kind with which the invention is concerned, the problem exists of bringing the two knife discs into their slightly overlapping operative positions from above and below, respectively of the material web that is to be cut, in a disturbance-free manner and extremely carefully, but in so doing bringing them reliably into operative engagement with one another. Whilst the lower knife disc is usually cup-shaped in configuration and is ground at its front edge, the top knife disc is usually flat and sharpened (or bevelled) at its periphery. It is imperative that this top knife disc be prevented from colliding radially with the lower knife disc, which is why the feed movement is ordinarily sub-divided into a radial feed movement and an axial feed movement, the latter of which must terminate only after the first radial movement. Also the sensitive edge of the top knife disc must be prevented from colliding in the axial direction hard against the front or end edge of the lower knife disc, whilst on the other hand an adequate pressure is necessary for satisfactory cutting.

In one known version of a knife holder for a longitudinal slitter or cutter, an attempt has been made to overcome the above discussed problem in that the spring forces counteracting the two linear drive members, which are in the form of cylinders, for the radial and axial feed movement respectively, and above all the bias thereof have been coordinated with one another, taking into account the respective piston areas, in such a way that both linear drive members become active only one after the other, with desired force. This coordination is, however, suspect in that the springs age and also the frictional resistance cannot be exactly calculated, even though the cylinder for the axial feed movement has been given a complex low-friction mounting. The friction forces, in combination with the elastic pressure and spring forces have, in addition thereto, a tendency to cause a slip-stick effect which may lead to sudden and heavy collision of the knife discs.

In another known version, the pneumatic pressure medium reaches the linear drive member for axial feed movement by way of a throttle member, so that this drive member responds with a time delay. However, this time delay, too, as well as the relevant feed speed and the knife pressure (or squeezing pressure), is dependent upon the existing pressure and upon the resilient restoring force, with which the response pressure of the drive member does indeed vary. In addition, here, too, the force equilibrium between pressure force and resilient force is disturbed by friction forces in the sense of a slip-stick effect.

A further knife holder known from German Offenlegungsschrift No. 28 21 956, has a reversing valve connected prior to the linear drive member, designed as a double-acting cylinder, for the axial feed movement, which reversing valve is dependent upon the pressure in the controlled feed line of the linear drive member for the radial feed movement and by way of which either the one cylinder side is feedable directly from the controlled feed line or else, for the relevant feed movement, the other cylinder is feedable by way of a reducing valve from a feed line of its own. In this instance, indeed the actuation pressure for the axial feed movement, and therewith also the axial feed speed, as well as the knife pressure, can be adjusted sensitively; however the relevant knife holder requires, as has been said, two feed lines. Also, the triggering point in time for the axial feed movement is not satisfactorily fixed, since the reversing valve operates as a function of the variable pressure in the feed line of the drive member for the radial feed movement, which in turn depends upon the relevant restoring resilient force. In addition, with the pressure forces which are effective on both sides also elastic forces are in equilibrium with one another, which, in conjunction with the unavoidable friction forces, have a tendency to cause a slip-stick effect.

SUMMARY OF THE INVENTION

The object of the invention is, therefore, to design a knife holder, of the kind referred to at the introduction hereto, in such a way that the response point in time, the feed speed and the feed end force (i.e. the knife pressure) of the linear drive member for the axial feed movement can be adjusted virtually independently of the relevant parameters of the linear drive member for the radial feed movement and, in addition to this, the axial feed movement proceeds as steadily as possible.

This problem is solved by providing for the flow-limiting member of the knife holder an adjustable reducing valve and for the linear drive member for the axial feed movement to act against shock absorbing means in addition to the relevant resilient force.

Because of the pressure of the reducing valve which is fed from the common feed line, the feed speed and the knife pressure of the linear drive member for the axial feed movement can be accurately adjusted, independently of the pressure in the feed line. For this, neither a second feed line nor a pressure-dependent reversing valve is required. The shock-absorbing means counters any slip-stick effect. In addition, however, it also crucially determines the feed speed, so that the knife pressure can be adjusted specifically or primarily with the reducing valve.

Advantageously also the resilient restoring force of the linear drive member for the axial feed movement can be applied by way of the shock-absorbing means. For this purpose, damping fluid is displaced through the linear drive member for the axial feed movement into an air vessel or other suitable chamber or reservoir. The pressure in the air vessel can in turn be adjustable by way of a reducing valve, which may be the same one with which the actuation pressure of the linear drive member for the axial feed movement is adjustable. These and further advantageous development possibilities form the subject of the sub-claims appended hereto.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
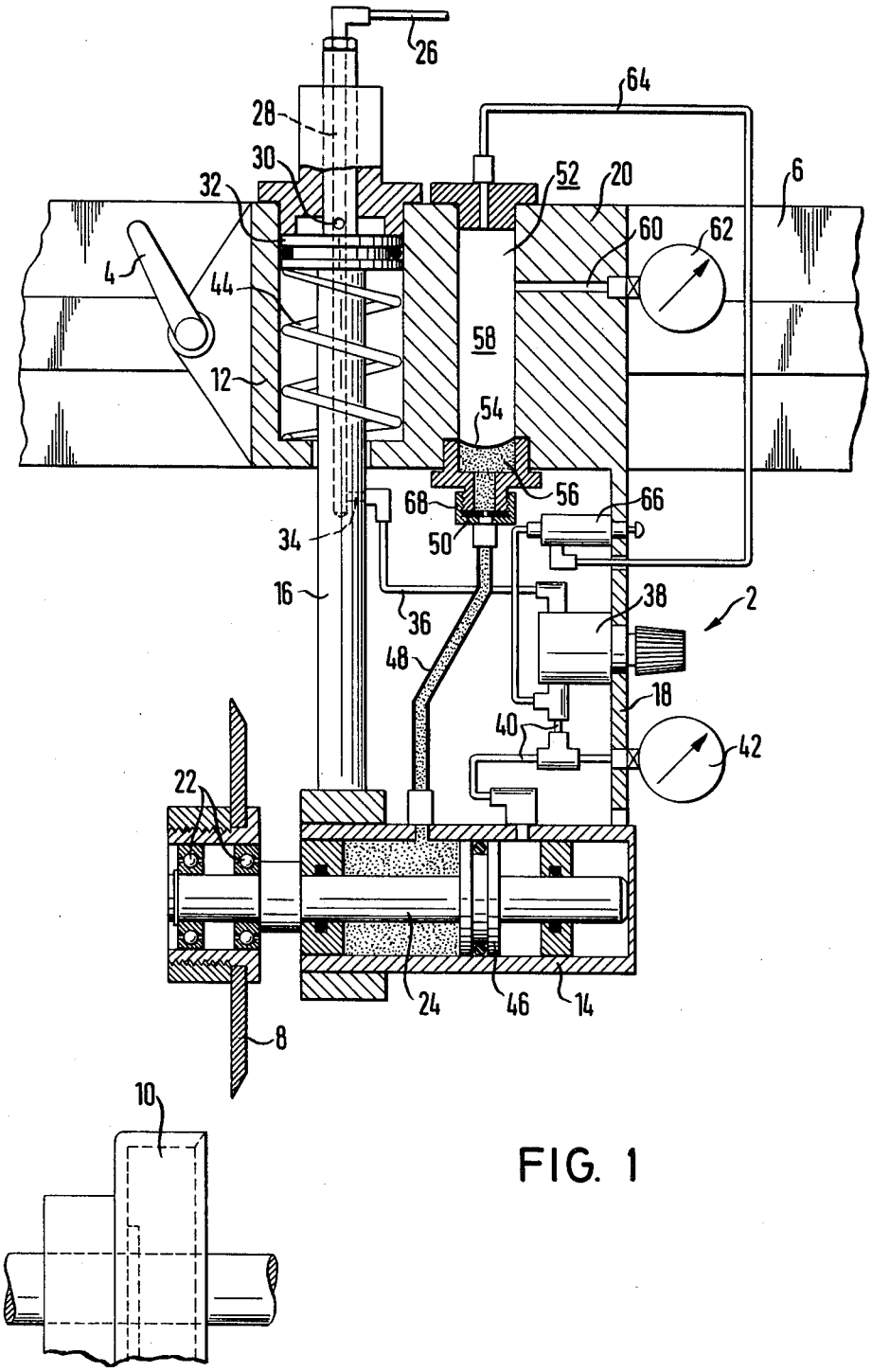
FIG. 1 is a diagrammatic partial sectional view of an embodiment of the knife holder in accordance with the invention.

A knife holder 2, shown in FIG. 1, is displaceable sidewards and is mounted so as to be securable, by way of a clamping lever 4, on a profile rail 6 of the machine frame. Such includes a top knife holder comprising a flat knife disc 8 which is able to cooperate with a rotatingly-driven, cup-shaped lower knife disc 10. For this purpose, the upper knife disc 8 is displaceable or lowerable by means of a linear drive member in the form of a pneumatic cylinder 12 (i.e. such is radially feedable with regard to the lower knife disc 10) and is axially feedable by means of a linear drive member in the form of a pneumatic cylinder 14.

The cylinder 14 is a double-acting cylinder and is disposed at the lower end of piston rod 16 of the cylinder 12. Additionally, it is guided in a cheek 18 which links at the lower side to a block 20 which forms, inter alia, the housing of the cylinder. Whilst the lower knife disc 10 is driven rotationally, the upper knife disc 8 is mounted by means of roller bearings 22 so as to be freely rotatable on an axle which is formed by piston rod 24 of the cylinder 14, so as to be entrained to run with the lower knife disc by friction.

The two cylinders 12 and 14, for the purposes of the feed movement, are fed by way of a common valve-controlled air feed line 26, which in this example opens out from above into the piston rod 16. A corresponding channel 28 in the piston rod 16 has a first outlet 30 above piston 32 in the cylinder 12 and a second outlet 34 underneath the cylinder 12. The outlet 34 is connected by way of a flexible line 36, an adjustable reducing valve 38 and a further flexible line 40, to that side of the cylinder 14 which is remote from the knife disc 8. Connected to the line 40 is a pressure gauge 42 which, in the same manner as the reducing valve 38, is mounted on the cheek 18. In this manner the side of the cylinder 14 which is away from the knife disc 8 is feedable from the feed line 26 with an adjustable reduced pressure.

Restoring of the piston 32 in the cylinder 12 is achieved by a helical spring 44 in the lower part of the cylinder, whilst that of the piston 46 in the cylinder 14 is effected in a different manner as will be described later.

That side of the cylinder 14 which faces the knife disc 8 is filled with a damping fluid and communicates, by way of a flexible line 48 and a throttle 50, with an air vessel 52 which is disposed beside the cylinder 12 in the block 20. More particularly, the air vessel 52 is subdivided by a flexible membrane 54 into two chambers 56 and 58 which are hermetically sealed relative to one another and of which only the first one receives damping fluid. The larger second chamber 58 communicates on the one hand by way of a channel 60 with a pressure gauge 62 and on the other hand by way of a line 64 and a push-button-actuatable shut-off valve 66 with the reducing valve 38, by way of which it is feedable under adjustable pressure with pneumatic pressure medium from the line 26. Alternatively to this, the pneumatic pressure medium could also be supplied to the chamber 58 by way of a reducing valve of its own (or by way of a suitable reducing valve) and possibly from a line of its own.

The throttle 50 consists, in the example shown, of an apertured partition or diaphragm which is inserted into a screw cap or retaining nut 68 at the entry into the chamber 56 of the air vessel 52.

Figure 2:
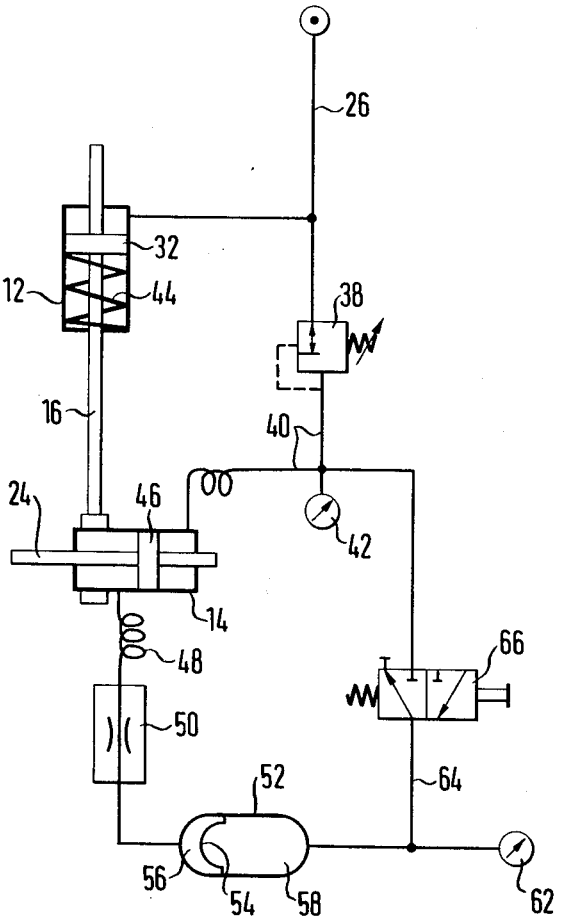
FIG. 2 shows a basic circuit diagram of the knife holder of FIG. 1.

In the circuit diagram of FIG. 2, the parts 12, 14, 16, 24, 26, 32, 38, 40, 42, 44, 46, 48, 50, 52, 54, 56, 58, 62, 64 and 64 can in principle be perceived. This figure shows how, upon actuation of the shut-off valve 66 along with suitable adjusting of the reducing valve 38, the chamber 50 is chargeable with pneumatic pressure medium from the line 26, which, after release of the shut-off valve 66, remains locked therein.

The pressure medium locked in the chamber 58 acts as a spring which, with mediation of the damping fluid in the chamber 56 and the cylinder chamber connected therewith, seeks to return the piston 46 of the pneumatic cylinder 14 to its initial position. In the event of actuation of the cylinder 14 from the line 26, the resilient force of the pressure medium to the chamber 58 counteracts the actuation pressure from the line 40, in a manner similar to the spring 44 counteracting the actuation pressure at the cylinder 12. The restoring spring force effective at the piston 46 can be adjusted with the pressure in the chamber 58 as a result of which primarily the knife pressure is controllable, independently of the adjustment of the actuation pressure for the cylinder 14.

If the pressure in the line 26 is reduced, the pistons of both cylinders return, under the action of the spring 44 and/or of the pressure medium confined in the chamber 58, into their initial positions shown in FIG. 1, in which the knife disc are separated from one another and in their inoperative positions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A knife holder for a longitudinal slitter, a rotary knife disc of which is displaceable relative to a second rotary knife disc cooperating therewith, comprising:

separate axial and radial pneumatic linear drive members adapted to be fed from a common controllable feed line, from an initial position, in which the knife discs are out of engagement, against a resilient restoring force, initially radially and then axially;

a flow-limiting member connected upstream of the axial linear drive member for the axial feed movement, wherein the flow-limiting member further comprises an adjustable reducing valve; and shock-absorbing means wherein said axial linear drive member for the axial feed movement acts against said shock-absorbing means in addition to said resilient restoring force.

2. A knife holder as claimed in claim 1, wherein the axial linear drive member for the axial feed movement further comprises a double-acting drive member, and further comprising a throttle member linked to a side thereof not acted upon by pressure from said common controllable feed line.

3. A knife holder as claimed in claim 2 further comprising an air vessel, wherein said side not acted upon of the axial linear drive member for the axial feed movement is acted upon hydraulically and communicates, by way of the throttle member, with said air vessel.

4. A knife holder as claimed in claim 3, further comprising a shut-off valve and an adjustable reducing valve means in series with said shut-off valve wherein pneumatic pressure of said air vessel is adjustable by way of said adjustable reducing valve means in series with said shut-off valve.

5. A knife holder as claimed in claim 4, wherein said adjustable reducing valve means further comprises said adjustable reducing valve connected to said axial linear drive member.

6. A knife holder as claimed in claim 3, 4 or 5 further comprising a housing for the radial linear drive member wherein said air vessel is integrated into said housing of the radial linear drive member.

7. A knife holder as claimed in claim 3, further comprising a membrane positioned in the air vessel and which separates hydraulic medium from pneumatic medium.

* * * * *